US011015825B2

(12) United States Patent
Lin et al.

(10) Patent No.: US 11,015,825 B2
(45) Date of Patent: May 25, 2021

(54) INTELLIGENT AIR-DRYING SYSTEM AND METHOD

(71) Applicant: Fortune Electric Co., Ltd., Taoyuan (TW)

(72) Inventors: Chia-Ching Lin, Taoyuan (TW); Ching-Min Chen, Taoyuan (TW)

(73) Assignee: FORTUNE ELECTRIC CO., LTD., Taoyuan (TW)

( * ) Notice: Subject to any disclaimer, the term of this patent is extended or adjusted under 35 U.S.C. 154(b) by 13 days.

(21) Appl. No.: 16/517,504

(22) Filed: Jul. 19, 2019

(65) Prior Publication Data

US 2021/0018197 A1 Jan. 21, 2021

(51) Int. Cl.

| | |
|---|---|
| ***F24F 11/64*** | (2018.01) |
| ***F24F 11/00*** | (2018.01) |
| ***F24F 3/14*** | (2006.01) |
| ***F24F 11/65*** | (2018.01) |
| ***F24F 6/10*** | (2006.01) |

(52) U.S. Cl.

CPC ..... *F24F 11/0008* (2013.01); *F24F 3/1411* (2013.01); *F24F 3/1429* (2013.01); *F24F 6/10* (2013.01); *F24F 11/64* (2018.01); *F24F 11/65* (2018.01)

(58) Field of Classification Search

CPC ..... F24F 3/1423; F24F 3/1417; G06Q 50/06
USPC ..... 700/278
See application file for complete search history.

(56) References Cited

U.S. PATENT DOCUMENTS

| | | | | |
|---|---|---|---|---|
| 2019/0154281 | A1* | 5/2019 | Rosenblum | F24F 11/76 |
| 2019/0154287 | A1* | 5/2019 | Pham | F24F 11/77 |
| 2019/0163154 | A1* | 5/2019 | Liang | G05B 19/048 |

FOREIGN PATENT DOCUMENTS

| | | | | |
|---|---|---|---|---|
| DE | 3657110 | A1 * | 11/2018 | F26B 3/04 |

* cited by examiner

*Primary Examiner* — Rocio Del Mar Perez-Velez
*Assistant Examiner* — Alicia M. Choi
(74) *Attorney, Agent, or Firm* — Li & Cai Intellectual Property (USA) Office

(57) ABSTRACT

An intelligent air-drying system and method are provided. The intelligent air-drying system includes an air-drying device and an application program. The air-drying device includes a device body, a sensing unit, a heater, and a processing unit. The device body has a water-absorbing material for absorbing moisture in the air. The sensing unit is disposed on the device body to detect the humidity of the environment where the air-drying device is located. The heater is disposed on the device body to heat the water-absorbing material. The processing unit is coupled to the sensing unit and the heater, and the processing unit executes the application program. The startup timing of the heater is dynamically predicted based on the daily humidity change measured by the sensing unit, and the heater is started before the water-absorbing material reaches saturation to ensure the water-absorbing and dehumidifying capabilities of the water-absorbing material.

14 Claims, 9 Drawing Sheets

INTELLIGENT AIR-DRYING SYSTEM AND METHOD

FIELD OF THE DISCLOSURE

The present disclosure relates to an air-drying system and method, and more particularly to an intelligent air-drying system and method for electrical equipment.

BACKGROUND OF THE DISCLOSURE

Insulation of electrical equipment can cause leakage currents and the increase of dielectric loss, which are important causes of insulation breakdown; therefore, it is necessary to prevent humid air from entering the electrical equipment. For example, large transformers (e.g., oil-immersed transformers) are equipped with oil storage tanks to account for volume changes caused by rising or falling temperatures of the insulating oil during operation; once the humid air enters the oil storage tank, the oil quality of the insulating oil will deteriorate, and the transformer's insulation performance may be degraded, and the transformer may be burnt due to the occurrence of insulation breakdown.

In order to keep the internal environment of the electrical equipment dry, an air-drying device is usually installed to dry the air entering the electrical equipment. The existing air-drying device can absorb moisture in the air through a desiccant, and can evaporate the moisture absorbed by the desiccant through a heater to restore the water absorption capacity of the desiccant. However, existing air-drying devices typically start the heater periodically at predetermined time intervals, or start the heater after determining that the desiccant is at or near water saturation, and these methods are unable to adapt to environmental changes.

Further, in climates such as that in Taiwan, the air in the summer is relatively humid, the time period in which the desiccant reaches water saturation is short; while the air in the winter season is relatively dry, and the time period in which the desiccant reaches water saturation is longer. When the heater periodically heats the desiccant at predetermined time intervals, additional electrical energy may be consumed, and it may not be possible to ensure that the desiccant is always active during operation of the electrical equipment. In addition, when the heater heats the desiccant until it is at or near water saturation, the electrical equipment needs to be shut down.

In addition, the operational status of electrical equipment may suddenly change due to external environmental factors. The existing air-drying device does not have a mechanism to cope with such situations, that is, it cannot prevent humid air from entering the electrical equipment under such conditions.

SUMMARY OF THE DISCLOSURE

In response to the above-referenced technical inadequacies, the present disclosure provides an intelligent air-drying system and method for dynamically reducing the time required for the water-absorbing material to be heated according to the daily humidity change of the external environment, so as to start the heater before the water absorption of the absorbing material reaches saturation.

In one aspect, the present disclosure provides an intelligent air-drying method applicable to an air-drying device, the air-drying device including a device body with a water-absorbing material and a heater disposed on the body of the device, and the water-absorbing material being capable of absorbing moisture in the air. The intelligent air-drying method includes: step S1: obtaining a daily average humidity value of the environment in which the air-drying device is located in the past L days, in which L≥2; step S2: calculating the difference between the average daily humidity value of the Nth day and the Mth day in the past L days, to obtain at least one humidity increase amount, in which N and M are integers, N≥2 and N>M≥1; step S3: obtaining at least one predicted reference value based on the humidity increase amount by using an empirical formula; step S4: obtaining a predetermined countdown start day according to at least one predicted reference value; and step S5: determining whether the predetermined countdown start day is less than or equal to 1 day; if the predetermined countdown start day is less than or equal to 1 day, the heater is started up to remove moisture absorbed by the water-absorbing material from the air; if the predetermined countdown start day is greater than 1 day, L is increased by 1 and steps S1 to S5 are repeated.

In one aspect, the present disclosure provides an intelligent air-drying system including an air-drying device and an application program. The air-drying device includes a device body, a sensing unit, a heater, and a processing unit. The device body has a water-absorbing material for absorbing moisture in the air, the sensing unit is disposed on the device body to detect a humidity change of an environment in which the air-drying device is located, the heater is disposed on the device body to heat the water-absorbing material, and the processing unit is coupled to the sensing unit and the heater. The application program is executed by the processing unit, and the processing unit performs the following steps when executing the application program: step S1: obtaining a daily average humidity value of the environment where the air-drying device is located in the past L days, in which L≥2; step S2: calculating the difference between the average daily humidity value of the Nth day and the Mth day in the past L days, to obtain at least one humidity increase amount, in which N and M are integers, N≥2 and N>M≥1; step S3: obtaining at least one predicted reference value by using an empirical formula, based on at least one of the humidity increase amounts; step S4: obtaining a predetermined countdown start day according to the at least one predicted reference value; and step S5: determining whether the predetermined countdown start day is less than or equal to 1 day; if the predetermined countdown start day is less than or equal to 1 day, the heater is started up to remove moisture absorbed by the water-absorbing material from the air; if the predetermined countdown start day is greater than 1 day, L is increased by 1 and steps S1 to S5 are repeated.

Therefore, one of the beneficial effects of the present disclosure is that the intelligent air-drying system and method provided by the present disclosure can dynamically predict the heating timing of the water-absorbing material according to the daily variation of the environmental humidity to evaporate the water it absorbs before the water-absorbing material approaches or reaches water saturation. Moreover, when the intelligent air-drying system and method of the present disclosure are applied to electrical equipment, it can be ensured that the electrical equipment draws in dry air during operation to effectively extend the service life of the electrical equipment.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
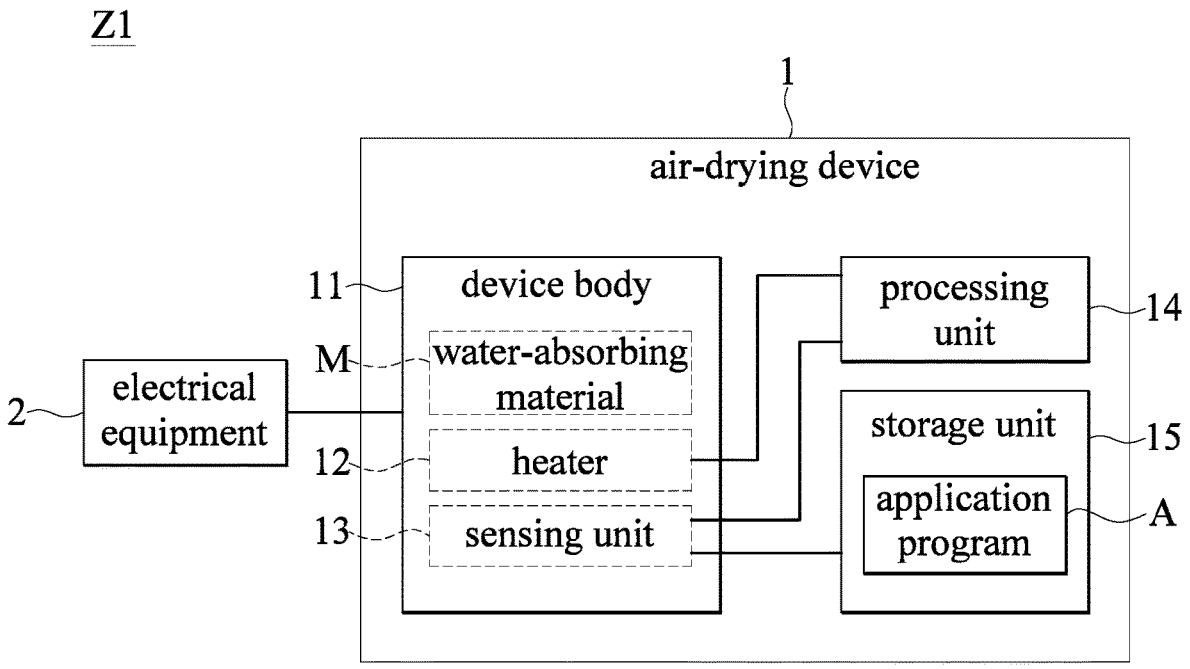
FIG. 1 is a functional block diagram of an intelligent air-drying system according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1, a first embodiment of the present disclosure provides an intelligent air-drying system Z1, which mainly includes an air-drying device 1 and an application program A installed in the air-drying device 1. The air-drying device 1 includes a device body 11, a heater 12, a sensing unit 13, and a processing unit 14. The device body 11 stores a water-absorbing material M (e.g., a desiccant), and the heater 12 and the sensing unit 13 are disposed on the device body 11. The processing unit 14 is coupled to the heater 12 and the sensing unit 13, and the processing unit 14 can execute the application program A. The specific structure of the air-drying device 1 is not the main focus of the present disclosure. Reference may be made to the Taiwan (R.O.C.) Patent No. 1563521 of the same applicant, which is not described in detail herein.

In the present embodiment, the apparatus body 11 may have a passage (not shown) for air to flow through, and when the air passes through the passage, the water-absorbing material M can absorb moisture in the air until it absorbs water to reach saturation. The heater 12 can heat the water-absorbing material M to evaporate the water absorbed by the water-absorbing material M, so that the water-absorbing material M can restore the water absorption and dehumidification ability. The sensing unit 13 can detect the daily change of the humidity of the environment where the air-drying device 1 is located. When the processing unit 14 executes the application program A, the start timing of the heater 12 can be dynamically predicted based on the daily change of the ambient humidity measured by the sensing unit 13, so as to start the heater 12 before the water-absorbing material M loses the water absorption and dehumidification capabilities. The air-drying device 1 may include a storage unit 15, and the application program A is stored in the storage unit 15.

The sensing unit 13 can be a temperature and humidity sensor. The processing unit 14 can be any type of processor or programmable circuit. The storage unit 15 can be any type of fixed or removable random access memory (RAM), read-only memory (ROM), flash memory or other similar component or a combination of the above. However, the above-mentioned examples are only one of the embodiments and the present disclosure is not limited thereto.

As shown in FIG. 1, the air-drying device 1 can be connected to an electrical equipment 2, so that the electrical equipment 2 communicates with the outside air through the air-drying device 1, thereby ensuring that the electrical equipment 2 draws in dry air during operation to effectively extend the service life of the electrical equipment 2.

Figure 2:
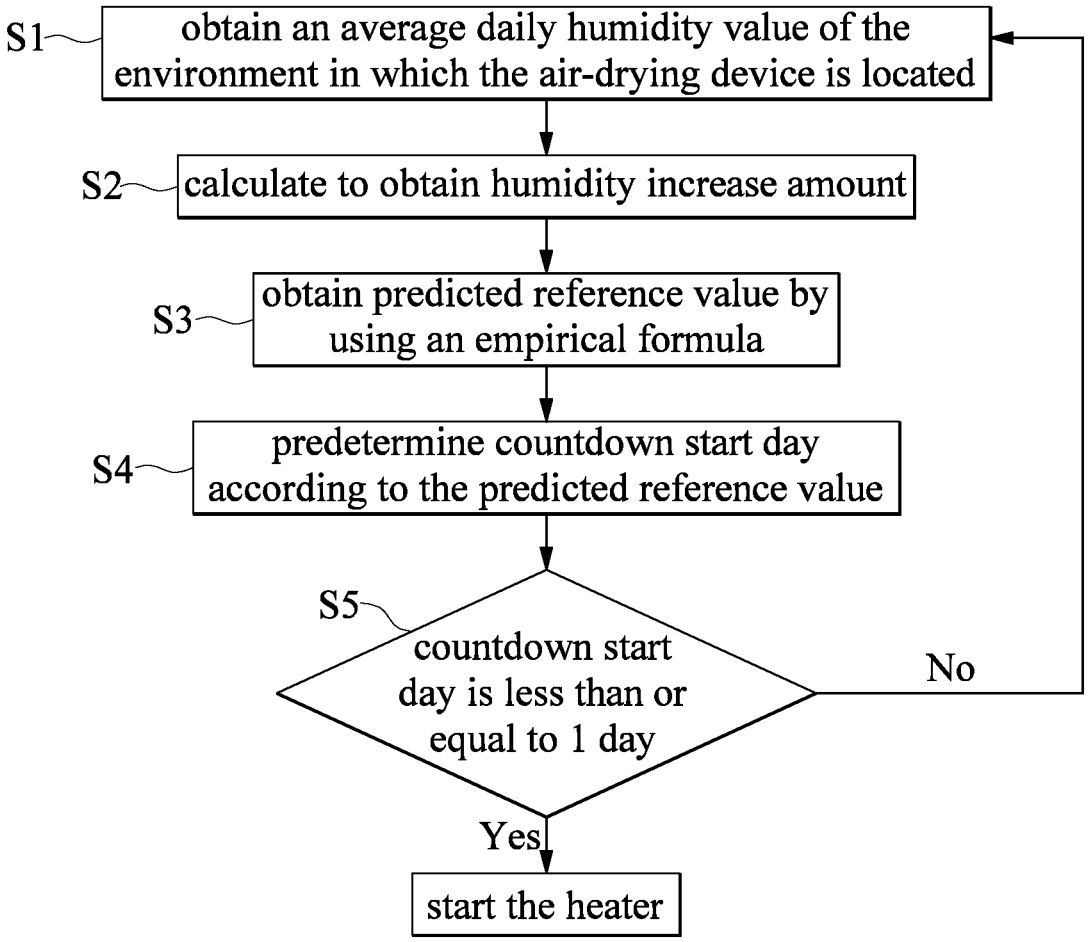
FIG. 2 is a flowchart of an intelligent air-drying method according to one configuration of the first embodiment of the present disclosure.

Referring to FIG. 1 and FIG. 2, the processing unit 14 mainly performs the following steps in executing the application program A. First, the processing unit 14 obtains the daily average humidity value (step S1) of the environment in which the air-drying device 1 is located in the past L days, in which $L \geq 2$. In practice, the sensing unit 13 of the air-drying device 1 can detect the ambient humidity for several specific time periods, such as four periods of morning, noon, afternoon, and evening, or six periods of morning, morning, noon, afternoon, evening, and late night. The humidity value measured by the sensing unit 13 can be transferred to the storage unit 15 for storage, and the processing unit 14 can average these humidity values to obtain the daily average humidity value and store it. It should be noted that "in the past L days" refers to the number of days that the air-drying device 1 continuously operates from the day after the completion of the heating of the water-absorbing material M.

Thereafter, the processing unit 14 calculates the difference between the daily average humidity values of the Nth day and the Mth day in the past L days to obtain at least one humidity increase amount (step S2), in which N and M are integers, N≥2 and N>M≥1. In practice, the humidity increase amount must be greater than or equal to 0, and the Nth day and the Mth day may be two consecutive days or not. Further, the processing unit 14 takes the Nth day as the Mth day firstly, and the daily average humidity value of the (N−1)th day is subtracted from the daily average humidity value of the Nth day to obtain the first difference, and then determines whether the first difference is greater than or equal to 0. If the first difference is greater than or equal to 0, the first difference is used as the humidity increase amount of the Nth day. If the first difference is less than 0, the processing unit 14 will then take the (N−2)th day as the Mth day, and the daily average humidity value of the (N−2)th day is subtracted from the daily average humidity value of the Nth day to obtain the second difference and then determines whether the first difference is greater than or equal to 0. If the second difference is greater than or equal to 0, the second difference is used as the humidity increase amount of the Nth day. If the second difference is still less than 0, the processing unit 14 will continue to subtract the daily average humidity value of the (N−3)th day from the daily average humidity value of the Nth day, and so on, until the resulting difference is greater than or equal to zero.

In one example, the daily average humidity values of the 16th to 20th days of the air-drying device 1 environment measured by the sensing unit 13 are 21.6%, 21.8%, 22.0%, 28.0%, and 25.0%, respectively. From this, it can be calculated that the humidity increase amount on day 17 is 0.2, and the humidity increase amount is the difference between the daily average humidity value on the 17th day and the daily average humidity value on the 16th day; the humidity increase amount on the 18th day is 0.2, and the humidity increase amount is the difference between the daily average humidity value on the 18th day and the daily average humidity value on the 17th day; the humidity increase amount on the 19th day is 6, and the humidity increase amount is the difference between the daily average humidity value on day 19 and the daily average humidity value on day 18; the humidity increase amount on day 20 is 3, and the humidity increase amount is the difference between the daily average humidity value on day 20 and the daily average humidity value on day 18.

Thereafter, the processing unit 14 obtains at least one predicted reference value based on at least one humidity increase amount using an empirical formula (step S3). In practice, the processing unit 14 can calculate the humidity increase amount every day after the start of the second day, and substitute the humidity increase amount generated on the day into the empirical formula to obtain the predicted reference value every day after the second day. In the present embodiment, the empirical formula is: $Y(N)=\alpha\cdot e\hat{}(\beta\cdot X(N))-(N-1)+K$. In the formula, Y(N) represents the predicted reference value of the Nth day; X(N) represents the humidity increase amount of the Nth day; α and β are empirical constants; and K represents the weighted index. It should be noted that when air-drying device 1 is in a damp environment, the weighted index K is positive; when the air-drying device 1 is in a less humid environment, the weighted index K is 0; when the air-drying device 1 is in a drier environment, the weighting index K is a negative value. Further, if the daily average humidity value of the Nth day falls within the first humidity range, K is taken as a positive value, and the first humidity range may be between 0% and 15%; if the daily average humidity value of the Nth day falls within the second humidity range, K is taken as 0, and the second humidity range may be between 16% and 24%; if the daily average humidity value of the Nth day falls within the third humidity range, K is taken as a negative value, and the third humidity range may be between 25% and 40%. However, the above-mentioned examples are only one of the embodiments and the present disclosure is not limited thereto.

In the above-mentioned example, the daily average humidity value on day 17 is 21.8% and the humidity increase amount is 0.2, and the values are substituted into the empirical formula to obtain a predicted reference value of 48.41 on the 17th day. On day 18, the daily average humidity value is 22.0% and the humidity increase amount is 0.2, and the values are substituted into the empirical formula to obtain the predicted reference value of 48.23 on the 18th day. On the 19th day, the daily average humidity value is 28.0% and the humidity increase amount is 6, and the values are substituted into the empirical formula to obtain the predicted reference value of 3.25 on the 19th day. On the 20th day, the daily average humidity value is 25.0% and the humidity increase amount is 3, and the values are substituted into the empirical formula to obtain the predicted reference value of 22.02 on the 20th day.

Thereafter, the processing unit 14 obtains a predetermined countdown start day based on the at least one predicted reference value (step S4). In practice, the humidity of the environment around air-drying device 1 will change with the daily weather, and the processing unit 14 can dynamically predict the predetermined countdown start day of the heater 12 by using one or more predicted reference values obtained in the past L days. A possible predicted result is that the heater 12 will be started after 10 days, the next day the heater 12 is predicted to start after 12 days, and the day after the next day the heater 12 is predicted to start after 8 days. In the present embodiment, the processing unit 14 substitutes the predicted reference values obtained after the start of the second day into the following formula: [sum of the predicted reference values of the second to N days/(N−1)]−(N−1), to calculate the predicted countdown start day of every day after the second day.

Thereafter, the processing unit 14 determines whether the predetermined countdown start day is less than or equal to 1 day (step S5). In practice, if the predetermined countdown start day of the Lth day is less than or equal to 1 day, the processing unit 14 may start the heater 12 on the next day; if the predetermined countdown start day of the Lth day is greater than 1 day, the processing unit 14 increases L by 1 and repeats the above steps. That is, according to the daily change of the environmental humidity during (L+1) days to obtain the predetermined countdown start day of the (L+1)th day. If the predetermined countdown start day of the (L+1) day is still greater than 1 day, the processing unit 14 increases L by 2 and repeats the above steps, and so on, until the predetermined countdown start day of one day is less than or equal to 1 day.

Figure 3:
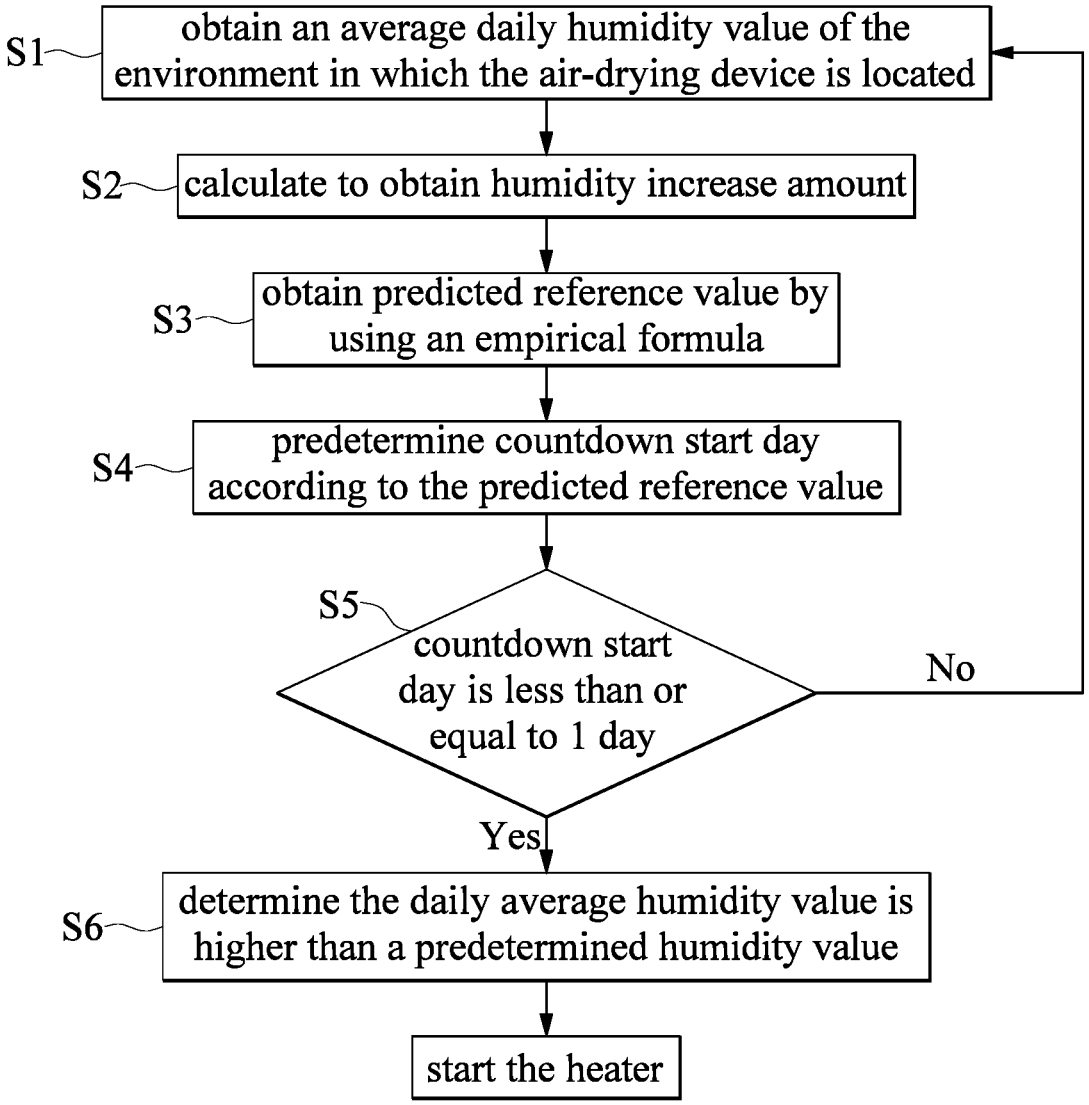
FIG. 3 is a flowchart of the intelligent air-drying method according to another configuration of the first embodiment of the present disclosure.
Figure 4:
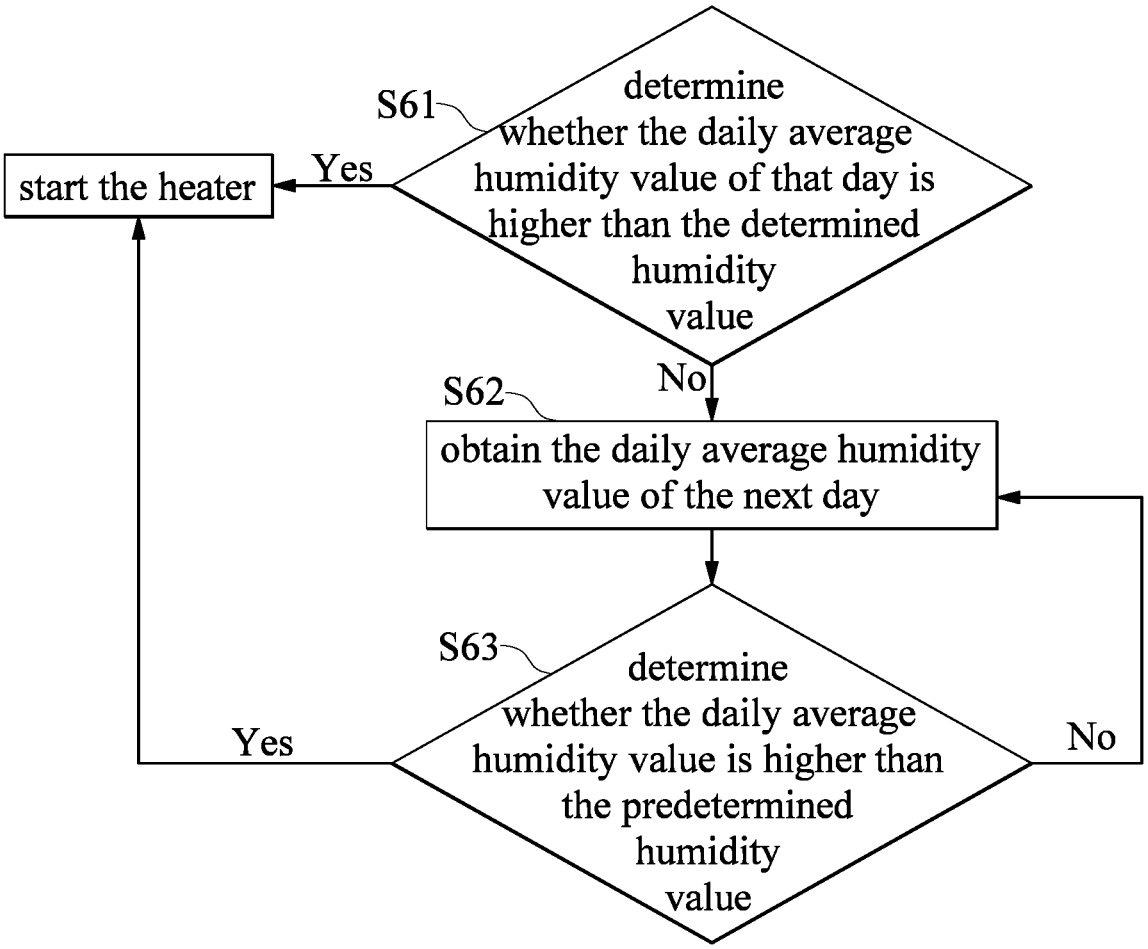
FIG. 4 is a detailed flow chart of step S6 shown in FIG. 3.

Referring to FIG. 3 and FIG. 4, the application program A may include startup conditions based on humidity. In this embodiment, when the predetermined countdown start day of the Lth day is less than or equal to 1 day, the processing unit 14 does not start the heater 12 until the daily average humidity value of the Lth day is determined to be higher than a predetermined humidity value (e.g., 20%) (step S6), only then is the heater 12 started up; that is, the heater 12 is started up only when both of the above-mentioned startup conditions are satisfied.

Further, when the predetermined countdown start day of the Lth day is less than or equal to 1 day, the processing unit 14 may then determine whether the daily average humidity value of the Lth day is higher than the determined humidity value (step S61); the daily average humidity value of the Lth day is higher than the predetermined humidity value, the processing unit 14 can start the heater 12 on the next day (i.e., the (L+1)th day). If the daily average humidity value of the Lth day is not higher than the predetermined humidity value, the processing unit 14 does not start the heater 12, and continues to obtain the daily average humidity value of the (L+1)th day (step S62), and then determines whether the daily average humidity value is higher than the predetermined humidity value (step S63); if the daily average humidity value of the (L+1)th day is higher than the predetermined humidity value, the processing unit 14 may start the heater 12 on the next day (i.e., (L+2) days). If the daily average humidity value of the first (L+1)th day still is not higher than predetermined humidity value, the processing unit 14 will obtain and determine whether the daily average humidity value of the (L+2)th day is higher than the predetermined humidity value, and so on, until one day when the daily average humidity value is higher than the predetermined humidity value.

Figure 5:
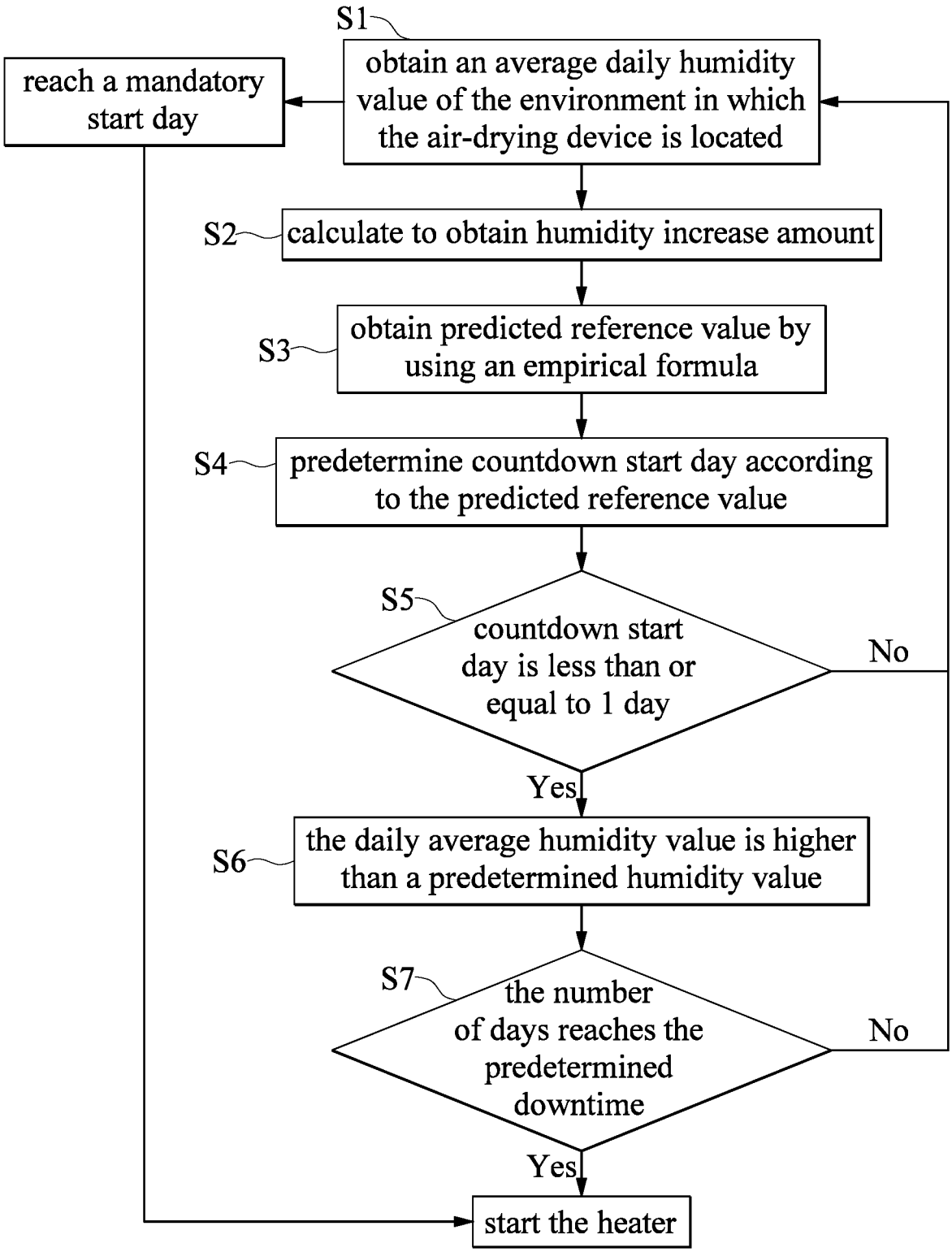
FIG. 5 is a flowchart of the intelligent air-drying method according to yet another configuration of the first embodiment of the present disclosure.

Referring to FIG. 5, the application program A may include a forced shutdown and forced activation mechanism for the heater. In this embodiment, even if the result made by the processing unit 14 is that the predetermined countdown start day of the Lth day is less than or equal to 1 day, and the daily average humidity value of the Lth day is higher than the predetermined humidity value, the Lth day must still be after the predetermined downtime (such as 15 days), or otherwise the heater 12 will not start. Thereby, it is possible to avoid misjudgment caused by drastic changes in environmental conditions, resulting in unnecessary energy consumption.

Further, when the predetermined countdown start day is less than or equal to 1 day, and the daily average humidity value of the Lth day is higher than the predetermined humidity value, the processing unit 14 further determines whether the Lth day reaches the predetermined downtime (step S7); if the Lth day reaches the predetermined downtime, the processing unit 14 can start the heater 12 on the next day (i.e., the L+1th day). If the first day L does not reach the predetermined downtime, the processing unit 14 does not start the heater 12, and the processing unit 14 repeats the above steps until the predetermined countdown start day of the day after the Lth day is less than or equal to 1 day, and the daily average humidity value is higher than the predetermined humidity value, before starting the heater 12.

In addition, if the heater 12 has not started for a long period of time, the heater 12 must be forced to start to ensure retention of the water absorption and dehumidification capabilities of the water-absorbing material M. In this embodiment, the processing unit 14 can determine whether the Lth day reaches a mandatory start day (for example, 60 days) when the daily average humidity value of the Lth day is obtained; if the Lth day has reached the mandatory start day, the processing unit 14 will start the heater 12 regardless of whether the above-mentioned start condition is met.

Second Embodiment

Figure 6:
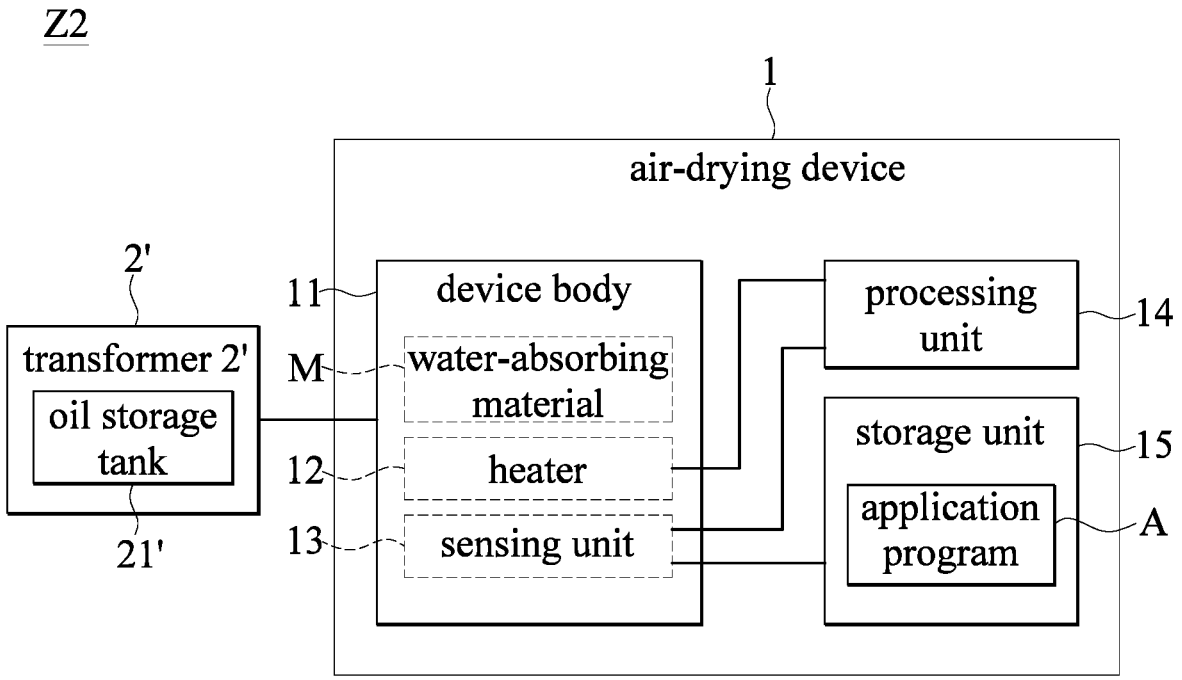
FIG. 6 is a functional block diagram of an intelligent air-drying system according to a second embodiment of the present disclosure.
Figure 7:
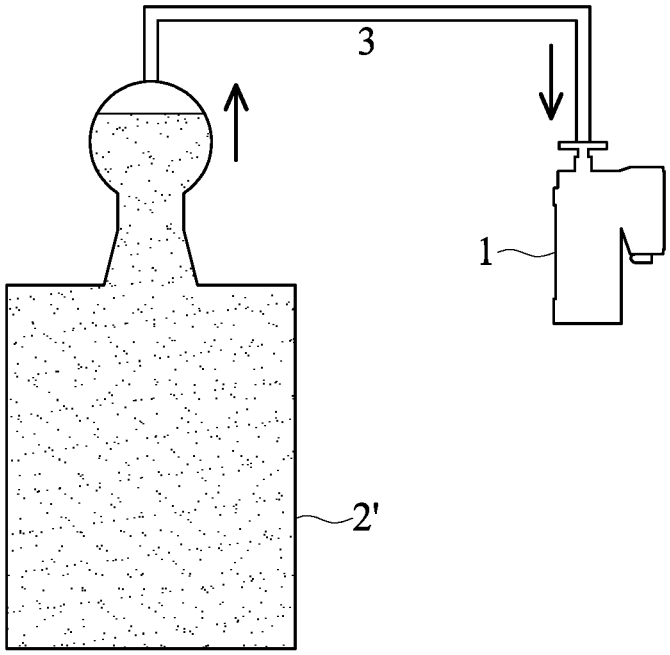
FIG. 7 is a schematic view of an intelligent air-drying system according to the second embodiment of the present disclosure in one state.
Figure 8:
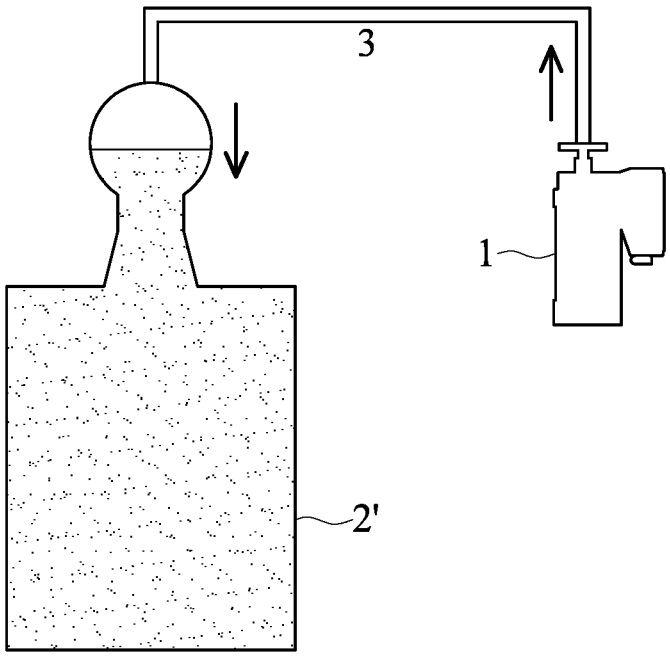
FIG. 8 is a schematic view of an intelligent air-drying system according to the second embodiment of the present disclosure in another state.

Referring to FIG. 6, FIG. 7 and FIG. 8, a second embodiment of the present disclosure provides an intelligent air-drying system Z2, which mainly includes an air-drying device 1, an application program A, and a transformer 2'. In the present embodiment, the transformer 2' is an oil-immersed transformer including an oil storage tank 21', and the air-drying device 1 is connected to the oil storage tank 21' through a pipeline 3 so that the oil storage tank 21' connects with the outside air through the air-drying device 1 to prevent humid air from entering the oil storage tank, thereby prolonging the service life of the transformer.

Figure 9:
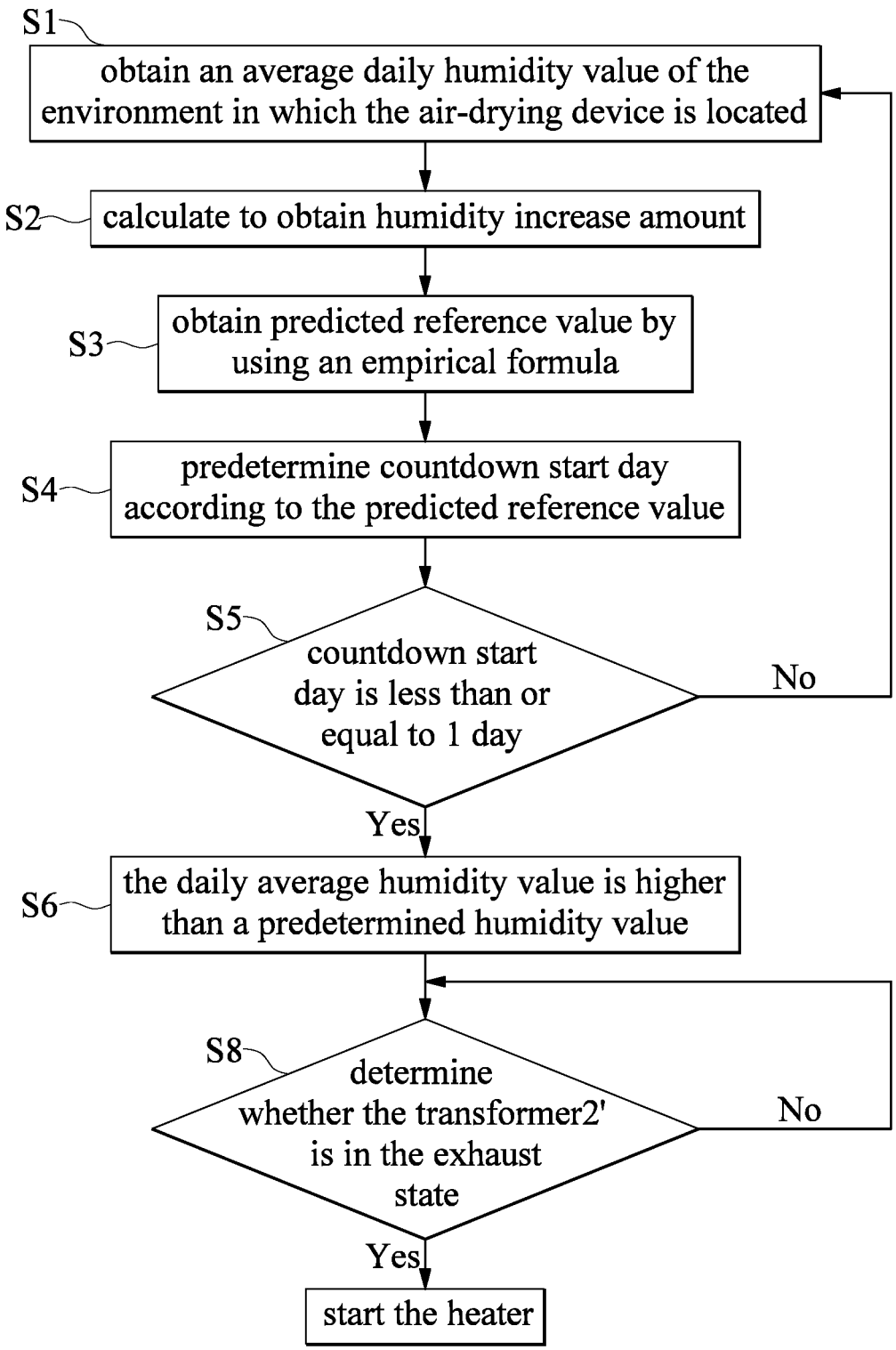
FIG. 9 is a flowchart of the intelligent air-drying method according to the second embodiment of the present disclosure.

Further, with reference with FIG. 9, in the present embodiment, the transformer 2' has an intake state and an exhaust state. Therefore, the start condition of the heater 12 includes a predetermined countdown start day, a predetermined daily average humidity value, and a transformer that is in the exhaust state. Further, after the determining unit 14 determines that the predicted countdown start day of the Lth day is less than or equal to 1 day, and the daily average humidity value of the Lth day is higher than the predetermined humidity value, the determining unit 14 also needs to determine whether the transformer 2' is in the exhaust state (step S8); if the transformer is in the exhaust state, the processing unit 14 starts the heater 12.

As shown in FIG. 7, the transformer 2' is in the exhaust state, that is, during the operation of the transformer 2', volume expansion would occur due to an increase in the temperature of the insulating oil resulting from an increase in load, causing the oil level to rise and the gas in the oil storage tank 21' to be discharged outward. As shown in FIG. 8, the transformer 2' is in the intake state, that is, during the operation of the transformer 2', the temperature of the insulating oil is lowered due to the drop of the load, which in turn causes volume contraction and the oil level to lower, allowing the outside air to enter the oil storage tank 21'.

It should be noted that during the period when the transformer 2' is in the exhaust state, the gas in the oil storage tank 21' flows from the inside to the outside, so that the water evaporated from the water-absorbing material M can be prevented from entering the oil storage tank 21' with the airflow which would cause the deterioration of the insulating oil. In the present embodiment, the processing unit 14 mainly determines whether the transformer 2' is in the exhaust state based on the operating state of the transformer 2'; when the transformer 2' is in a specific heating mode, the processing unit 14 determines that the transformer 2' is in the exhaust state.

Figure 10:
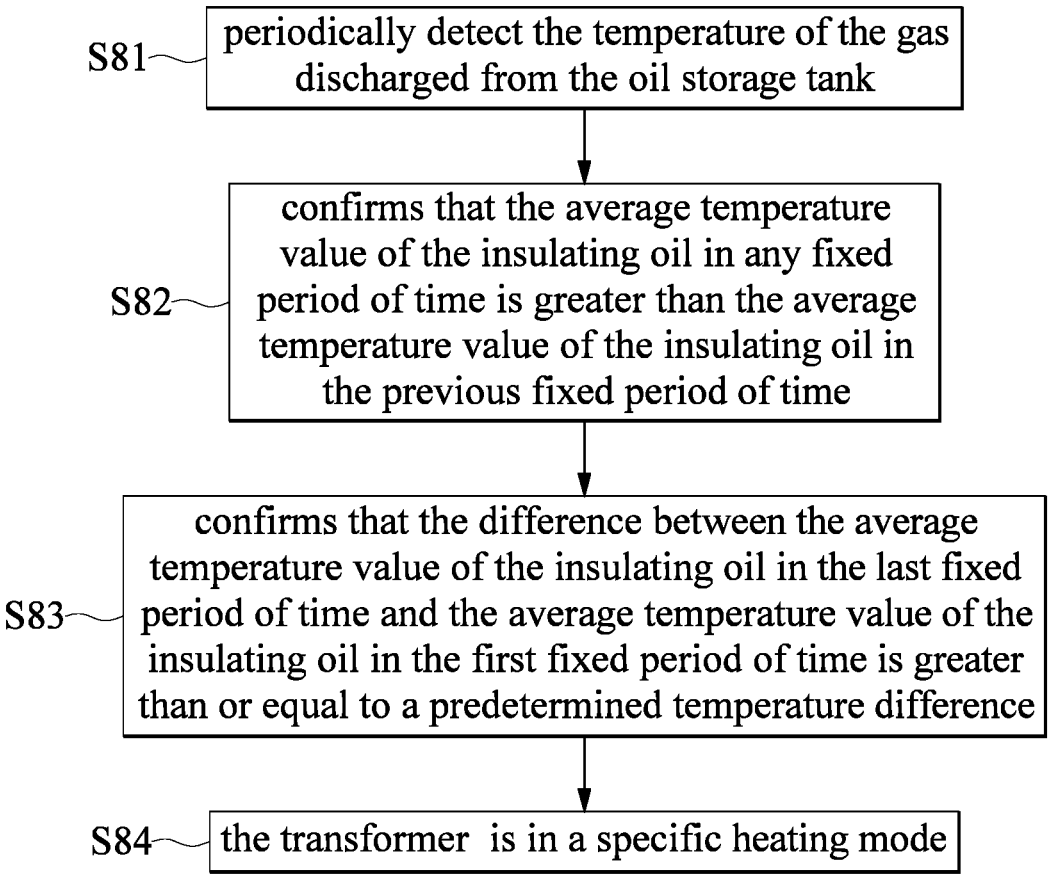
FIG. 10 is a detailed flow chart of step S8 shown in FIG. 9.

Referring to FIG. 10, in practice, the sensing unit 13 of the air-drying device 1 can periodically detect the temperature of the gas discharged from the oil storage tank 21' (step S81) to obtain an average temperature value of the insulating oil for a plurality of fixed time periods. Thereafter, the processing unit 14 first confirms that the average temperature value of the insulating oil in any fixed period of time is greater than the average temperature value of the insulating oil in the previous fixed period of time (step S82), and then confirms that the difference between the average temperature value of the insulating oil in the last fixed period of time and the average temperature value of the insulating oil in the first fixed period of time is greater than or equal to a predetermined temperature difference (e.g., 3.3° C.) (step S83). When both of the above conditions are met, the processing unit 14 determines that the transformer 2' is in a specific heating mode (step S84). In this way, it is possible to avoid misjudgment caused by drastic changes in environmental conditions (such as the phenomenon of temperature returning back in the morning).

In one example, the sensing unit 13 measures the oil temperature once every period of time (e.g., 20 seconds), and the temperature values that the sensing unit 13 continuously measures (e.g., 10 times) can form a temperature data. In this way, a plurality of temperature data (for example, 10 groups) can be obtained, and an average temperature value can be calculated from each temperature data. The specific heating mode may be characterized with a continuous increase in the average temperature value, and the difference between the average temperature value of the last temperature data and the average temperature value of the first temperature data being greater than or equal to the predetermined temperature difference.

The application program A may further include a mechanism for interrupting the heating of the water-absorbing material M in time to prevent the water evaporated from the water-absorbing material M from entering the oil storage tank 2' as the deformer 2' suddenly changes from the exhaust state to the intake state. In practice, the sensing unit 13 can continuously detect the humidity value of the gas discharged from the oil storage tank 21' during the startup of the heater 12; then, the processing unit 14 can obtain and determine whether the humidity value measured by the sensing unit 13 is higher than a preset humidity value (for example, 60%); if the humidity value measured by the sensing unit 13 is higher than the preset humidity value, the processing unit 14 immediately turns off the heater 12 to interrupt the heating of the water-absorbing material M.

In conclusion, one of the beneficial effects of the present disclosure is that the intelligent air-drying system and method provided by the present disclosure can dynamically predict the heating timing of the water-absorbing material according to the daily variation of the environmental humidity to evaporate the water it absorbs before the water-absorbing material approaches or reaches water saturation. Moreover, when the intelligent air-drying system and method of the present disclosure are applied to electrical equipment, it can be ensured that the electrical equipment draws in dry air during operation to effectively extend the service life of the electrical equipment.

Furthermore, in the process of dynamically predicting the heating timing of the water-absorbing material, a forced shutdown mechanism of the heater can be added to avoid misjudgment caused by drastic changes in environmental conditions that result in unnecessary energy consumption. Also, a forced activation mechanism of the heater can be added to ensure retention of the water absorption and dehumidification capabilities of the water-absorbing material.

Furthermore, if the electrical equipment is a transformer, the present disclosure starts the heater when the transformer is determined to be in an exhaust state to prevent the evaporation of moisture from the water-absorbing material, which may lead to the deterioration of the insulating oil as the gas flows into the transformer's oil storage tank. In addition, the present disclosure adds a mechanism to timely interrupt the heating of the water-absorbing material in response to a sudden change in the direction of the gas flowing in the system.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application program so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An intelligent air drying method applicable to an air-drying device that includes a device body having a water-absorbing material capable of absorbing moisture in the air and a heater air-drying device disposed on the device body, comprising:

S1: obtaining an average daily humidity value of the environment in which the air-drying device is located in the past L days, L>2;

S2: calculating a difference between the daily average humidity value of the Nth day and the Mth day in the past L days, to obtain at least one humidity increase amount, N and M being integers, N>2 and N>M>1;

S3: obtaining at least one predicted reference value based on the humidity increase amount by using an empirical formula;

S4: obtaining a predetermined countdown start day according to the predicted reference value;

S5: determining that the predetermined countdown start day is less than or equal to 1 day, wherein in response to the predetermined countdown start day being less than or equal to 1 day, the heater air-drying device is started up to remove moisture absorbed by the water-absorbing material from the air; and S6: determining that the predetermined countdown start day is less than or equal to 1 day, wherein in response to the predetermined countdown start day being greater than 1 day, L is increased by one and steps S1 to S5 are repeated.

2. The intelligent air drying method according to claim 1, wherein in step S5, when the predetermined countdown start day is less than or equal to 1 day, whether the average daily humidity value of the Lth day is higher than a predetermined humidity value is further determined; wherein, if the average daily humidity value of the Lth day is higher than the predetermined humidity value, the heater is started up; if the average daily humidity value of the Lth day is not higher than the predetermined humidity value, the daily average humidity value of the (L+1)th day of the environment in which the air-drying device is located is continuingly obtained, and then whether the daily average humidity of the (L+1)th day is higher than the predetermined humidity value is determined; wherein, if the average daily humidity value of the (L+1) day is higher than the predetermined humidity value, the heater is started up.

3. The intelligent air drying method according to claim 1, wherein in step S1, the method further comprises: determining whether the Lth day reaches a mandatory start day, and if the Lth day reaches the mandatory start day, the heater is started up.

4. The intelligent air drying method according to claim 2, wherein in step S5, the method further includes: when the predetermined countdown start day is less than or equal to 1 day, and when the average daily humidity value of the Lth day is higher than the predetermined humidity value, whether the Lth day reaches a predetermined downtime is further determined; wherein, if the Lth day reaches a predetermined downtime, the heater is started up on the (L+1)th day; if the predetermined downtime is not reached on the Lth day, the heater is not activated, and L is increased by 1 and steps S1 to S5 are repeated.

5. The intelligent air drying method according to claim 2, wherein the air-drying device is connected to a transformer to absorb moisture entering the air of the transformer; wherein, in step S5, when the predetermined countdown start day is less than or equal to 1 day, and the average daily humidity value of the Lth day is higher than the predetermined humidity value, whether the transformer is an intake state or exhaust state is further determined, and if the transformer is in the exhaust state, the heater is started up.

6. The intelligent air drying method according to claim 1, wherein in step S2, the method further includes:

the average daily humidity value of the (N−1)th day is subtracted from the average daily humidity value of the Nth day to obtain a first difference;

determining whether the first difference is greater than or equal to 0, and if the first difference is greater than or equal to 0, using the first difference as the humidity increase amount of the Nth day; if the difference is less than 0, continuing with the following steps:

the average daily humidity value obtained on the (N−2)th day is subtracted from the average daily humidity value obtained on the Nth day to obtain a second difference; and determining whether the second difference is greater than or equal to 0, and if the second difference is greater than or equal to 0, the second difference is used as the humidity increase amount of the Nth day.

7. The intelligent air drying method according to claim 1, wherein the empirical formula is: $Y(N)=\alpha\cdot e^{\wedge}(\beta\cdot X(N))-((N-1))+K$, wherein Y (N) represents the predicted reference value of the Nth day, X(N) represents the humidity increase amount of the Nth day, α and β are empirical constants, and K represents the weighted index, wherein Z(N) represents a daily average humidity value of the Nth day; wherein, when the daily average humidity value of the Nth day is within a first humidity range, K is a positive value; when the daily average humidity value of the Nth day is within a second humidity range, K is 0; when the daily average humidity value is in a third humidity range, K is a negative value; wherein, the humidity value in the second humidity range is greater than the humidity value in the first humidity range, and the humidity value in the third humidity range is greater than the humidity value in the second humidity range.

8. An intelligent air-drying system comprising:

an air-drying device including: a device body having a water-absorbing material for absorbing moisture in the air;

a sensing unit disposed on the device body to detect a humidity change of an environment in which the air-drying device is located;

a heater disposed on the device body for heating the water-absorbing material; and a processing unit coupled to the sensing unit and the heater; and an application program executed in the processing unit, wherein the processing unit performs the following steps when executing the application program:

S1: obtaining an average daily humidity value of the environment in which the intelligent air-drying system is located in the past L days, L>2;

S2: calculating a difference between the daily average humidity value of the Nth day and the Mth day in the past L days, to obtain at least one humidity increase amount, N and M being integers, N>2 and N>M>1;

S3: obtaining at least one predicted reference value based on the humidity increase amount by using an empirical formula;

S4: obtaining a predetermined countdown start day according to the predicted reference value; and S5: determining that the predetermined countdown start day is less than or equal to 1 day, wherein in response to the predetermined countdown start day being less than or equal to 1 day, the heater air-drying device is started up to remove moisture absorbed by the water-absorbing material from the air; and S6: determining that the predetermined countdown start day is less than or equal to 1 day, wherein in response to the predetermined countdown start day being greater than 1 day, L is increased by one and steps S1 to S5 are repeated.

9. The intelligent air drying system according to claim 8, wherein in step S5, when the predetermined countdown start day is less than or equal to 1 day, whether the average daily humidity value of the Lth day is higher than a predetermined humidity value is further determined by the processing unit; wherein, if the average daily humidity value of the Lth day is higher than the predetermined humidity value, the heater is started up by the processing unit; if the average daily humidity value of the Lth day is not higher than the predetermined humidity value, the daily average humidity value of the (L+1)th day of the environment in which the air-drying device is located is continuingly obtained, and whether the daily average humidity of the (L+1)th day is higher than the predetermined humidity value is determined; wherein, if the average daily humidity value of the (L+1) day is higher than the predetermined humidity value, the heater is started up by the processing unit.

10. The intelligent air drying system according to claim 8, wherein step S1 further includes: determining whether the Lth day reaches a mandatory start day by the processing unit, and if the Lth day reaches the mandatory start day, the heater is started up by the processing unit.

11. The intelligent air drying system according to claim 9, wherein in step S5 further includes: when the predetermined countdown start day is less than or equal to 1 day, and when the average daily humidity value of the Lth day is higher than the predetermined humidity value, whether the Lth day reaches a predetermined downtime is further determined by the processing unit; wherein, if the Lth day reaches the predetermined downtime, the heater is started up on the (L+1)th day by the processing unit; if the predetermined downtime is not reached on the Lth day, the heater is not activated by the processing unit, and L is increased by 1 and steps S1 to S5 are repeated.

12. The intelligent air drying system according to claim 9, further comprising a transformer, wherein the air-drying device is connected to the transformer to absorb moisture entering the air of the transformer; and, in step S5, when the predetermined countdown start day is less than or equal to 1 day, and the average daily humidity value of the Lth day is higher than the predetermined humidity value, the processing unit further determines whether the transformer is an intake state or an exhaust state, if the transformer is in an exhaust state, the heater is started up by the processing unit.

13. The intelligent air drying system according to claim 8, wherein in step S2 further includes:

the average daily humidity value of the (N−1)th day is subtracted from the average daily humidity value of the Nth day to obtain a first difference;

determining whether the first difference is greater than or equal to 0, and if the first difference is greater than or equal to 0, using the first difference as the humidity increase amount of the Nth day; if the difference is less than 0, continuing with the following steps:

the average daily humidity value obtained on the (N−2)th day is subtracted from the average daily humidity value obtained on the Nth day to obtain a second difference; and determining whether the second difference is greater than or equal to 0, and if the second difference is greater than or equal to 0, the second difference is used as the humidity increase amount of the Nth day.

14. The intelligent air drying system according to claim 8, wherein the empirical formula is: $Y(N)=\alpha\cdot e\hat{}(\beta\cdot X(N))-((N-1))+K$, wherein Y (N) represents the predicted reference value of the Nth day, X(N) represents the humidity increase amount of the Nth day, α and β are empirical constants, and K represents the weighted index, wherein Z(N) represents a daily average humidity value of the Nth day; wherein, when the daily average humidity value of the Nth day is within a first humidity range, K is a positive value; when the daily average humidity value of the Nth day is within a second humidity range, K is 0; when the daily average humidity value is in a third humidity range, K is a negative value; wherein, the humidity value in the second humidity range is greater than the humidity value in the first humidity range, and the humidity value in the third humidity range is greater than the humidity value in the second humidity range.

* * * * *